United States Patent [19]

Malek et al.

[11] 3,934,757

[45] Jan. 27, 1976

[54] REFRIGERATOR WATER DISPENSER WITH CHILD-PROOF GUARD

[75] Inventors: Raymond P. Malek, Norridge; Leroy R. Maleck, Galesburg, both of Ill.

[73] Assignee: Container Corporation of America, Chicago, Ill.

[22] Filed: Dec. 20, 1974

[21] Appl. No.: 534,838

[52] U.S. Cl. ..... 222/76; 62/339

[51] Int. Cl.[2] ..... B67D 5/06

[58] Field of Search..... 222/146 C, 173, 183, 76, 222/108; 141/360–362; 62/141, 7, 99, 306, 189, 108, 339, 395

[56] References Cited

UNITED STATES PATENTS

| | | | |
|---|---|---|---|
| 2,845,964 | 8/1958 | Harland | 141/361 X |
| 3,343,721 | 9/1967 | Paley | 222/76 X |
| 3,429,140 | 2/1969 | White | 62/339 |

*Primary Examiner*—Stanley H. Tollberg
*Attorney, Agent, or Firm*—Carpenter, Ostis & Lindberg

[57] ABSTRACT

A refrigerator is provided with a dispenser having a child-proof guard therewith for preventing the unwanted use of the dispenser. The refrigerator is connected to a fluid source and the cooled fluid is dispensed through a wall of the refrigerator. The dispenser is provided with structure for preventing unintended dispensing, and comprises a discharge spout located with reference to the wall of the refrigerator and adapted to discharge into a receptacle held in proximity thereto. Structure is controlled by movement of the receptacle and determines discharge or cessation of the discharge and includes a valve connected in the fluid source with structure for controlling the valve including a switch connected in circuit therewith. An actuating member is supported on the structure and cooperates with the receptacle to actuate the control structure which in turn includes structure movable selectively between a shut-off position and a discharge position.

3 Claims, 7 Drawing Figures

FIG. 1
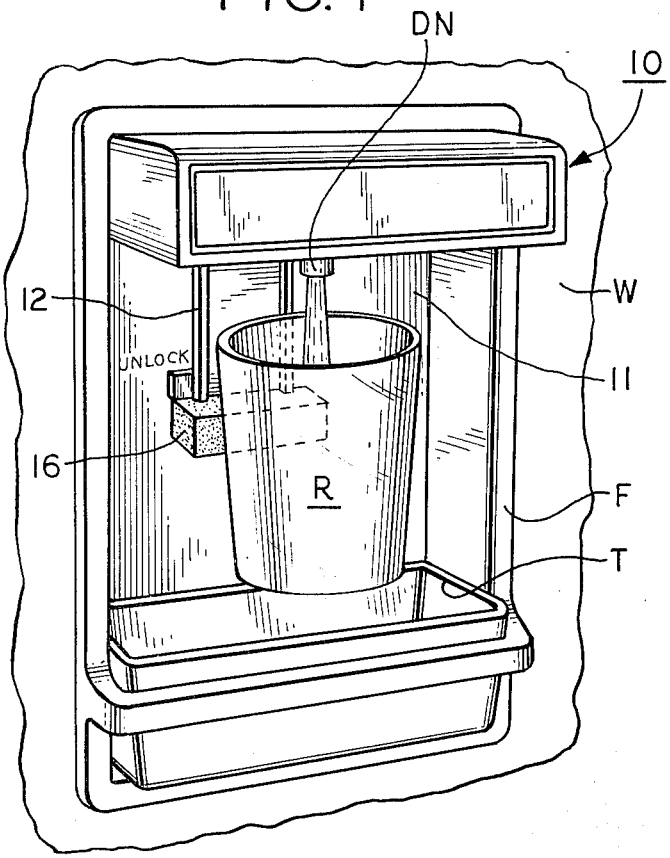
FIG. 2
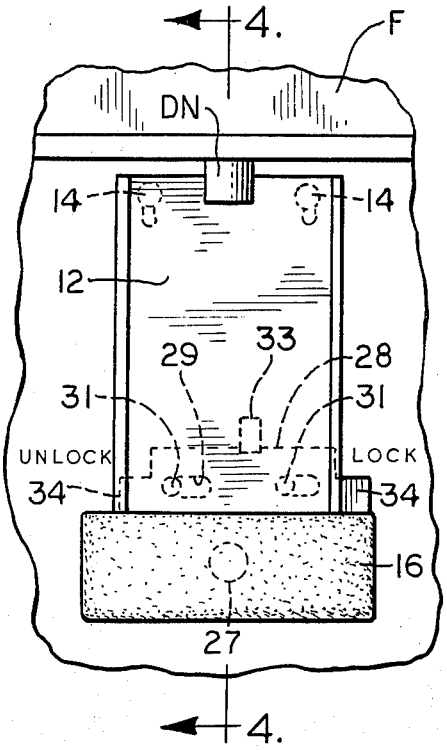
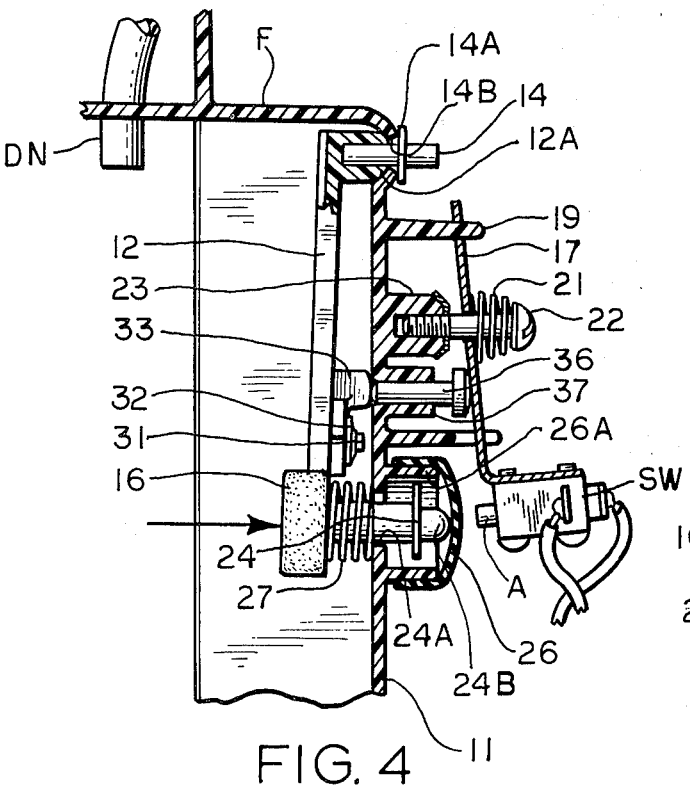
FIG. 4
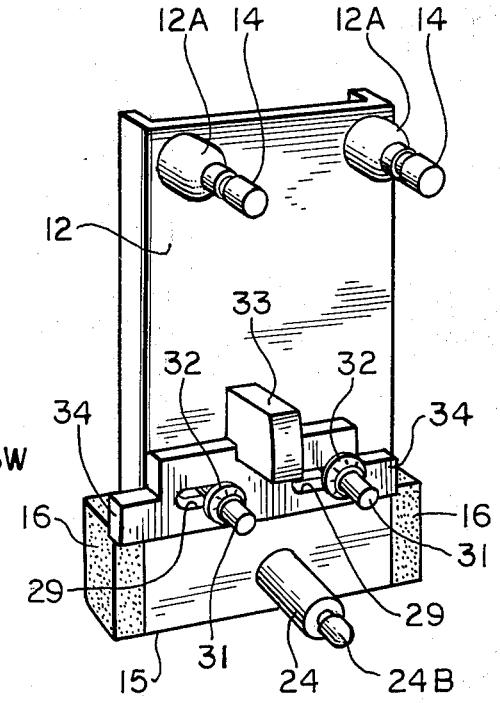
FIG. 3

FIG. 5
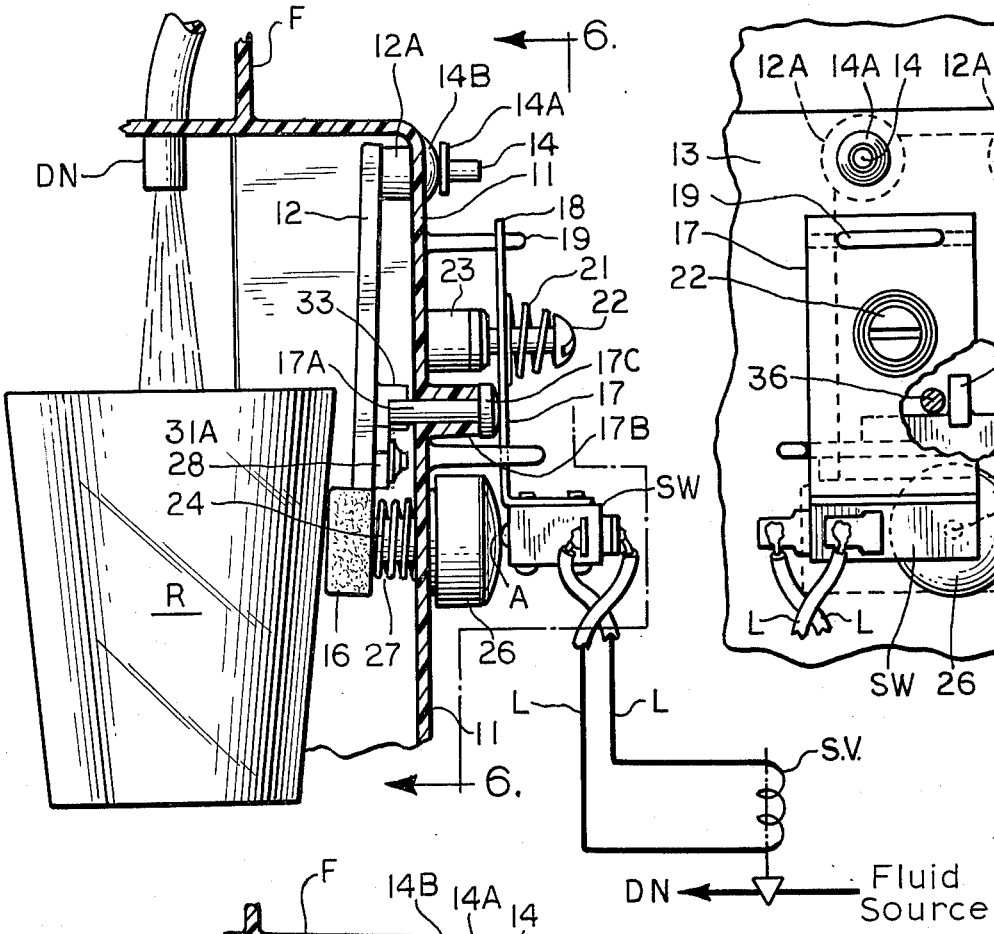
FIG. 6
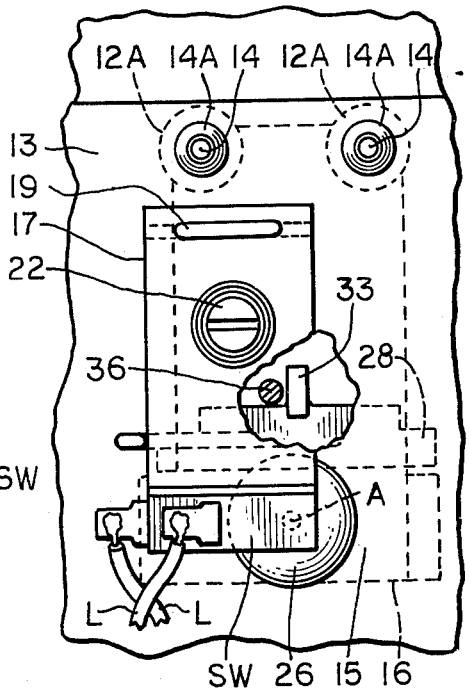
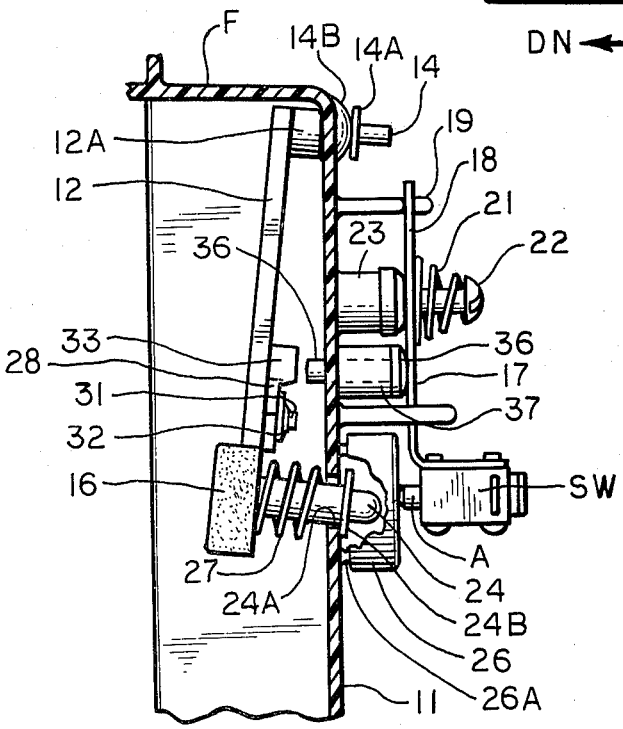
FIG. 7

REFRIGERATOR WATER DISPENSER WITH CHILD-PROOF GUARD

BACKGROUND OF THE INVENTION

1. Field of the Invention

This invention relates generally to devices for dispensing cold water or other liquids from the refrigerator without the need of opening the door thereof.

2. Prior Art

The prior art as developed in a search appears to be best exemplified in the following patents:

| | | | |
|---|---|---|---|
| Pinkerton et al | Re. 18,169 | Aug. 25, 1931 | |
| Taymans et al | 2,297,814 | Oct. 6, 1942 | 62/141 |
| Sundberg | 2,512,395 | June 20, 1950 | 62/141 |
| Jackson | 2,527,308 | Oct. 24, 1950 | 62/7 |
| Sebens | 2,644,318 | July 7, 1953 | 62/99 |
| Shikles, Jr et al | 2,894,377 | July 14, 1959 | 62/306 |
| Middleton | 3,031,860 | May 1, 1962 | 62/189 |
| Brugioni | 3,208,641 | Sept. 28, 1965 | 222/108 |
| Benua et al | 3,333,438 | Aug. 1, 1967 | 62/395 |
| White | 3,429,140 | Feb. 25, 1969 | 62/339 |

The invention herein appears to be distinguishable from the prior art in the provision of an unobtrusive on-off mechanism whereby the dispenser is inoperable. The unobtrusive on-off device makes the unwanted use of the dispenser by children, for example.

SUMMARY OF THE INVENTION

Modern day refrigerators are often times provided with storage for water, the storage being connected to a public supply and including a valve operable as desired. Ordinarily, the drawing of the water from the supply can be accomplished only after the refrigerator door is opened, and such structure is generally located out of reach of small children, for example. According to the invention herein, structure is provided in a wall of the refrigerator whereby the cooled water can be discharged into a receptacle located in the wall, the receptacle controlling the discharge of the liquid. In order to prevent unintended use by small children or the like, a shut-off structure is provided which is unobtrusive in appearance, and ordinarily not capable of being operated by small children.

THE DRAWINGS

FIG. 1 is a perspective view showing a water dispenser disclosed in a wall of a refrigerator and having structure incorporated therewith to prevent the unintended use thereof;

FIG. 2 is a front elevational view to a larger scale of the dispenser seen in FIG. 1;

FIG. 3 is a perspective view showing the rear of actuating mechanism shown in FIGS. 1 and 2;

FIG. 4 is a section taken along the line 4—4 of FIG. 2 looking in the direction of the arrows, and showing the dispenser in locked position;

FIG. 5 is a view similar to FIG. 4 showing a receptacle in position to actuate the mechanism and showing the discharge into a receptacle located thereat;

FIG. 6 is a rear view looking in the direction of the arrows 6—6 of FIG. 5, and showing the mechanism ready for dispensing; and FIG. 7 is a side elevational view, certain parts thereof being shown in cross section, showing the structure according to the present invention ready to be actuated.

The improved dispenser according to the present invention is referred to generally by the reference numeral 10 and is shown as being mounted on a wall W of a domestic refrigerator having structure therein for cooling water or other liquid from a source.

Structure 10 includes a frame F mounted in a opening of the wall W, the frame F holding a tray T for spilled water, and having a discharge nozzle DN adapted to discharge water into a receptacle R shown in position beneath a discharge nozzle DN. Frame F has a back wall 11, and a actuator lever 12 is adapted to be supported by the back wall 11, there being a pair of spaced pins at the top portions of actuator 12 extending through a pair of spaced hemispherical bosses 12A at the upper end thereof. A pin 14 extends through each boss 12A and through mating seat 14B in frame wall 12. A C-ring 14A in engagement with each pin 14 holds the actuator 12 in position for movement as will be described. The lower end of actuator 12 is provided with a cross member 15 covered by a pad 16 of resilient material adapted to be engaged by the receptacle R.

The actuator 12 is adapted to engage with a pin 17A slidable within a hollow boss 17B extending inward from the rear wall 11, the pin 17A having a head 17C thereon engageable with a arm 18 pivotally supported at a hanger 19 extending inward from the rear wall 11. The lower end of the arm 18 has a switch SW secured thereto in any convenient manner.

A pair of leads L extending from the switch SW are connected to a solenoid valve SV controlling a fluid source shown, it being connected through the solenoid valve SV to discharge nozzle DN.

Arm 18 is restrained in its movement by a screw 22 tapped into a boss 23, a spring 21 being interposed between screw 22 and the arm 18 to bias the arm 18 and the switch SW to the left as seen in FIG. 5.

A switch actuator 24 extends through an opening 24A in the rear wall 11 from the back face of the cross member 15, there being a spring 27 interposed between the front of the rear wall 11 and the cross member 15 to urge actuator 12 in a clockwise direction as seen in FIG. 4. The clockwise movement of actuator 12 is restrained by a keeper 24B in the form of a C-ring and the free end of the actuator 24 extends within a hollow boss 26A extending inward from the rear of the back wall 11, the hollow boss 26A being covered by a cap 26 interposed between the end of actuating pin 24 and actuator A of switch SW.

The back face of the actuator 12 has a lock-unlock slide 28, slide 28 supporting a finger 33. The slide 28 is held in position for movement along spaced pins 31, the slide 28 having slots 29 for such movement. Each of the pins 31 retains the slide 28 in position by a locking clip 31A, and the slide 28 is adapted to move from an unlocked position shown in FIG. 1, left end of the slide 28 being concealed behind the actuator 12, and the right end of slide end 28 being exposed, the exposure thereof marking the locked position of the actuator 12.

Normally, when the slide 28 is in the unlocked position, finger 33 is out of contact with pins 36, and the actuator 26 is in contact with switch actuator A of the switch SW to open the solenoid valve SV for discharge of liquid in the discharge nozzle DN.

When the slide 28 is moved to the left to the locked position, member 33 is in contact with pin 17A to pivot arm 18 in a counter-clockwise direction to prevent contact of actuator 26 with actuator A of switch SW. The position of the parts at this time is as seen in FIG.

4 and the position in FIG. 4 may be compared with the positions seen in FIG. 7(which is prior to placement of the receptacle R in position), and FIG. 5 where the receptacle is in position, the switch SW being closed and the valve SV being actuated for discharge.

We claim:

1. In a refrigerator having a connection to a fluid source for cooling fluid within said refrigerator and dispensing said cooled fluid through a wall of said refrigerator, the combination therewith of a dispenser having structure for preventing unintended dispensing of said fluid, said structure comprising:

a. discharge spout for said fluid located with reference to said wall and adapted to discharge fluid into portable receptacle held in proximity to said discharge means;

b. means controlled by movement of said receptacle determinative of discharge or cessation of said discharge comprising:

i. a power operated valve connected in said fluid source;

ii. means for controlling said vlave including a switch connected in a circuit with said valve;

iii. an actuating member supported on said structure and cooperating with said portable receptacle to actuate said control means;

c. means supported on said structure and shiftable selectively between shut-off and discharge positions, said shut-off position preventing actuation of said actuating member, said discharge position enabling said actuating member to be actuated.

2. The invention according to claim 1 wherein said actuating means supports said shiftable means.

3. The invention according to claim 2 wherein said shiftable means includes a member mounted on said actuating member.

* * * * *

UNITED STATES PATENT OFFICE

CERTIFICATE OF CORRECTION

Patent No. 3,934,757 Dated January 27, 1976

Inventor(s) Raymond P. Malek et al.

It is certified that error appears in the above-identified patent and that said Letters Patent are hereby corrected as shown below:

On the Cover Sheet, item "[73]" should read:

-- Assignee: Montgomery Ward & Co., Incorporated, Chicago, Ill. --.

Signed and Sealed this

Third Day of August 1976

[SEAL]

*Attest:*

RUTH C. MASON
*Attesting Officer*

C. MARSHALL DANN
*Commissioner of Patents and Trademarks*